US006014108A

United States Patent [19]

Lynch et al.

[11] Patent Number: 6,014,108

[45] Date of Patent: Jan. 11, 2000

[54] TRANSVERSE-FOLDED SCANNING ANTENNAS

[75] Inventors: Jonathan J. Lynch, Oxnard; John Pasiecznik, Malibu, both of Calif.

[73] Assignee: Hughes Electronics Corporation, El Segundo, Calif.

[21] Appl. No.: 09/058,232

[22] Filed: Apr. 9, 1998

[51] Int. Cl.[7] ..... H01Q 19/00

[52] U.S. Cl. ..... 343/753; 343/755; 342/175

[58] Field of Search ..... 343/757, 753, 343/761, 705, 755, 756; 342/175

[56] References Cited

U.S. PATENT DOCUMENTS

| | | | |
|---|---|---|---|
| 3,797,020 | 3/1974 | Roger et al. | 343/756 |
| 4,220,957 | 9/1980 | Britt | 343/756 |
| 4,413,263 | 11/1983 | Amitay et al. | 343/756 |
| 4,471,359 | 9/1984 | Howard | 343/754 |
| 4,504,835 | 3/1985 | Howard et al. | 343/755 |
| 4,574,287 | 3/1986 | Waters | 343/756 |
| 5,455,589 | 10/1995 | Huguenin et al. | 342/175 |

*Primary Examiner*—Don Wong
*Assistant Examiner*—James Clinger
*Attorney, Agent, or Firm*—V. D. Duraiswamy; M. W. Sales

[57] ABSTRACT

Transverse-folded antennas arrange a radiator, twist reflectors and a transreflector to generate a radar beam without blocking the beam with a feed element. The arrangement provides signal access at an antenna rear face which facilitates integration of the antenna into an automotive radar system. Different embodiments of the antenna collimate the radar beam with curved twist reflectors and with lenses. Scanning is effected with rotatable twist reflectors and with scanning radiators.

31 Claims, 5 Drawing Sheets

TRANSVERSE-FOLDED SCANNING ANTENNAS

BACKGROUND OF THE INVENTION

1. Field of the Invention

The present invention relates generally to antennas and more particularly to scanned antennas.

2. Description of the Related Art

Investigators around the world are working on the development of automotive radar systems for a variety of uses (e.g., adaptive cruise control and collision-avoidance). In addition to signal generating, receiving and processing circuits, a key element of these radar systems is a compact antenna that can cooperate with the generating circuits and radiate a scanned radar beam. Obstacles that are interrogated by the scanned beam generate an echo which is received by the antenna and coupled to the receiving and processing circuits.

For an automotive radar to be commercially viable, it must operate with low maintenance costs over a long lifetime and its elements are preferably based on well-developed technologies so as to reduce technical and schedule risks. Additionally, the radar must be light weight, low cost, and spatially compact while delivering good performance (e.g., high gain and low sidelobes). Space for an automotive radar is limited and, in particular, vertical space is particularly scarce. Accordingly, signal access to the antenna is preferably on its rear face to reduce the radar's vertical height.

One way of enhancing an antenna's side lobe performance is to increase its focal length but this process tends to increase the antenna's size. Antenna focal paths are, therefore, often spatially "folded" to reduce antenna volume. One conventional folding technique produces a Cassegrain antenna which illuminates a subreflector with a small radiator (e.g., a feed horn). Energy reflected from the subreflector then illuminates the antenna's primary reflector (the signal may also be collimated by passage through a lens). Antenna size is reduced because the focal path is folded twice. Although the feed antenna and the subreflector facilitate folding of the focal path, they block a portion of the path and degrade the antenna's gain and side lobe performance.

Various antenna structures have been developed to retain the benefits of focal path folding while reducing the degrading effects of a Cassegrain antenna.

In an exemplary antenna structure (e.g., see U.S. Pat. No. 4,220,957 issued Sep. 2, 1980 to Britt), a feedhorn protrudes through an aperture in a main reflector which includes a first grid of wire conductors. Positioned in front of the main reflector is a subreflector formed from a second grid of wire conductors that are oriented at 45° to the conductors of the first grid. Radiation from the feed horn is initially reflected from the subreflector to the main reflector. Upon reflection from the main reflector, the radiation is collimated and its polarization rotated so that it now passes through the subreflector.

In another exemplary antenna structure (e.g., see U.S. Pat. No. 5,455,589 issued Oct. 3, 1995 to Huguenin, et al.), radiation passes through an aperture in a twistreflector and is reflected from a transreflector back to the twistreflector. The radiation's polarization is rotated as it is reflected from the transreflector. Accordingly, the radiation now passes through the transreflector and is collimated by a lens.

Although these exemplary antennas eliminate the subreflector path blockage of a Cassegrain antenna, they respectively require a horn aperture in a main reflector and a twistreflector so that gain and side lobe performance is still degraded.

In another exemplary antenna structure (e.g., see U.S. Pat. No. 3,797,020 issued Mar. 12, 1974 to Roger, et al.), a polarization discriminator is positioned between a radiator and a subreflector. A main reflector is laterally spaced from the polarization discriminator. The subreflector and the main reflector include twist reflector structures. Accordingly, radiation from the radiator initially passes through the polarization discriminator but is reflected from it to the main reflector after reflection and polarization rotation by the subreflector. The main reflector reflects the radiation and again rotates the polarization so that the radiation now passes through the polarization discriminator.

Although this arrangement removes the subreflector path blockage of a Cassegrain antenna and the aperture requirement of Britt and Huguenin, et al., it precludes signal access at an antenna rear face which inhibits its integration into an automotive radar system.

SUMMARY OF THE INVENTION

The present invention is directed to high-performance, compact, low-cost, transverse-folded antennas for applications such as scanning in an automotive radar system.

These goals are realized with an antenna that includes a radiator, first and second twist reflectors and a transreflector. The radiator is positioned to radiate electromagnetic radiation along an antenna radiation axis, the twist reflectors are spaced apart along an antenna transverse axis that is transverse to the radiation axis and the transreflector is positioned across the radiation axis and the transverse axis.

Electromagnetic radiation from the radiator is thus successively reflected along the transverse axis from the transreflector, reflected along the transverse axis with a first polarization twist from the first twist reflector, transmitted along the transverse axis and through the transreflector, reflected along the transverse axis with a second polarization twist from the second twist reflector and reflected along the radiation axis from the transreflector.

Vertical space is severely limited in automotive applications of the invention. Antennas of the invention therefore position the radiator on the radiation axis and at an antenna rear wall which provides access to a signal generating, receiving and processing unit that is positioned aft of the antenna. This arrangement advantageously reduces the vertical height of an automotive radar system.

One antenna embodiment includes an electromagnetic lens that is positioned across the radiation axis with the transreflector between the radiator and the lens—the lens thus facilitating collimation of the radiation. In another antenna embodiment, first and second twist reflectors are curved along different transverse axes to facilitate radiation collimation.

In another antenna embodiment, at least one of the first and second twist reflectors is rotatably mounted to realize a simple, inexpensive and durable structure for beam scanning. Still other embodiments of the invention realize beam scanning through radiator translation (e.g., with patch elements of a radiator array).

Although antennas of the present invention can be used in any application that requires excellent performance (e.g., high gain and low side lobes) and compact size, they are particularly suited for millimeter wave, automotive scanning applications.

The novel features of the invention are set forth with particularity in the appended claims. The invention will be best understood from the following description when read in conjunction with the accompanying drawings.

DETAILED DESCRIPTION OF THE PREFERRED EMBODIMENTS

Figure 1A:
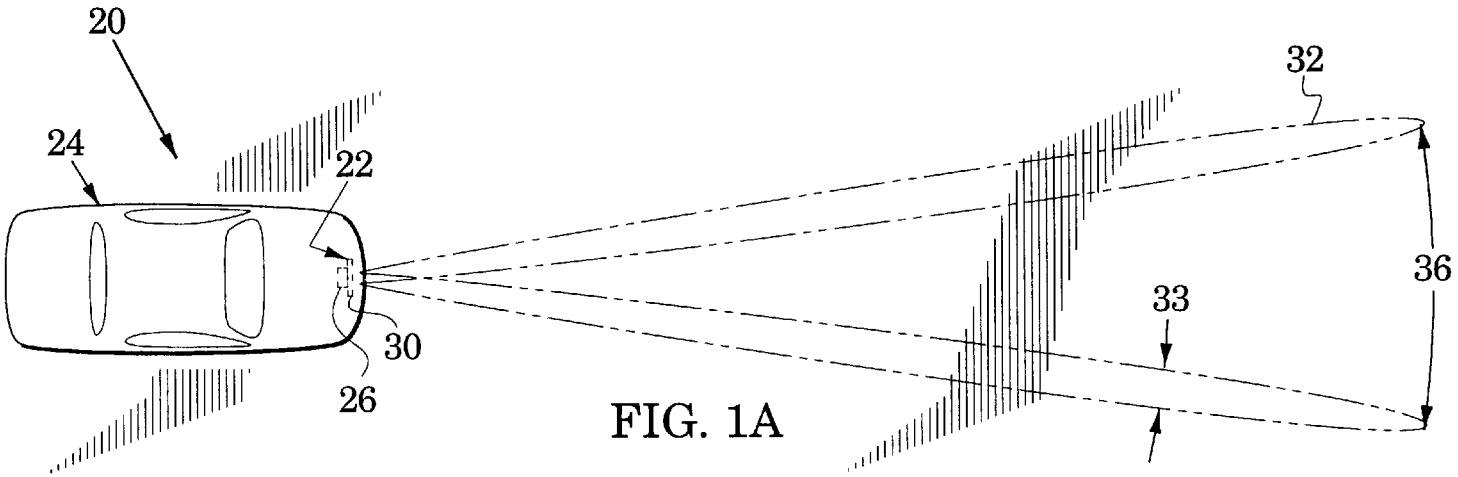
FIGS. 1A and 1B are top plan and side elevation views respectively of an automobile which has includes an automotive radar antenna of the present invention.
Figure 1B:
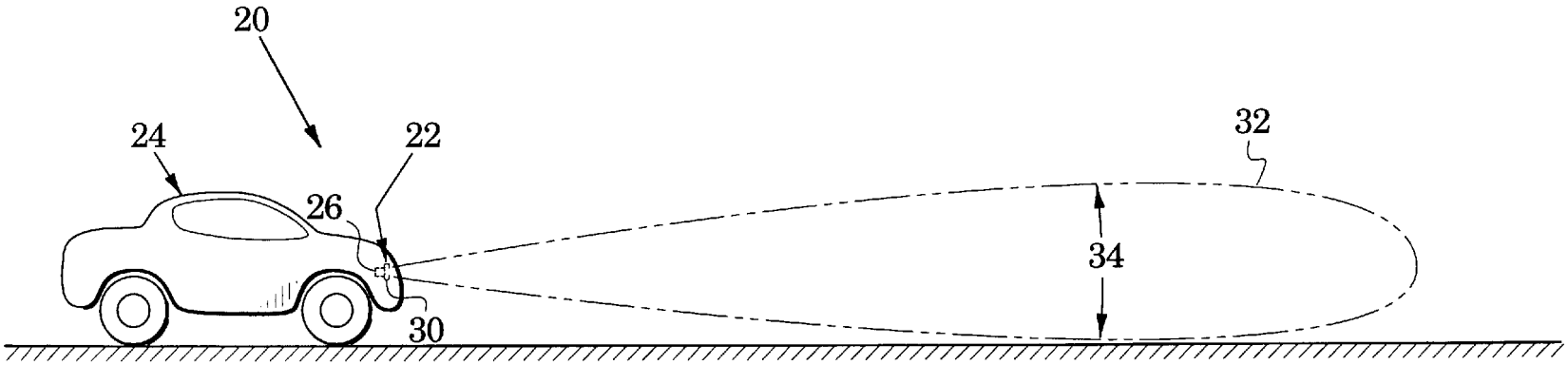

An automotive system 20 is shown in FIGS. 1A and 1B. The system includes an automotive radar system 22 that is carried by a motor vehicle 24. The radar system has a signal generating, receiving and processing unit 26 that is coupled to space by a transverse-folded antenna 30 which radiates and scans an electromagnetic beam 32.

The beam has an azimuth beam width 33 that is narrow enough (e.g., 2°) to discriminate between objects in the vehicle's path (e.g., motor vehicles in different traffic lanes). The beam also has an elevation beam width 34 that is wide enough (e.g., 5.5°) to radiate any objects that could strike the motor vehicle 24 but not so wide as to radiate false targets (e.g., an overpass). In addition, the antenna scans the beam 32 over a scan angle 36 that is sufficient (e.g., 16°) to radiate objects in the motor vehicle's path and at a scan rate (e.g., 5 Hz) that is compatible with expected closing velocities of these objects.

Figure 3:
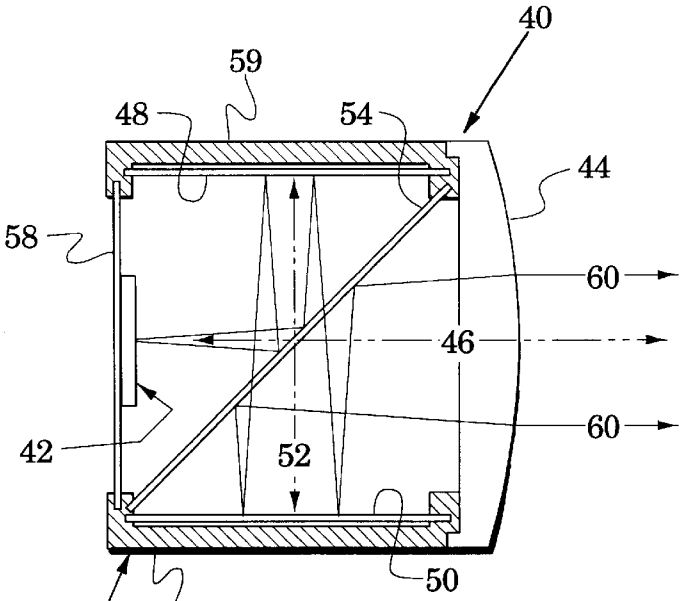
FIG. 3 is a cross sectional view of the antenna of FIG. 2.
Figure 2:
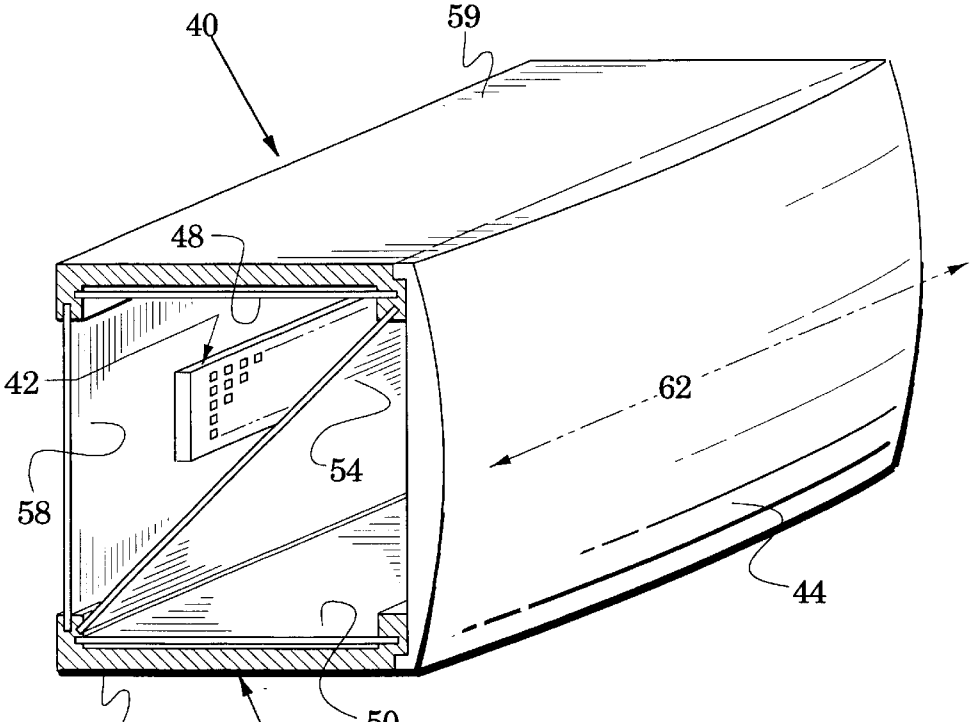
FIG. 2 is an isometric view of an embodiment of the antenna of FIGS. 1A and 1B with a near wall removed for clarity of illustration.

An embodiment 40 of the antenna 30 of FIGS. 1A and 1B is shown in FIGS. 2 and 3. The antenna 40 has an electromagnetic radiator 42 in the form of a patch array and an electromagnetic lens 44 that is spaced from the radiator along an antenna radiation axis 46. The antenna also has a first twist reflector 48 and a second twist reflector 50 that is spaced from the first twist reflector along an antenna transverse axis 52 that is transverse to the radiation axis. A transreflector 54 is spaced along the radiation axis 46 from the radiator 42 and positioned between the first and second twist reflectors. These antenna elements are carried on a frame 56 which includes a back wall 58 and side walls 59.

In operation of the antenna 40, radiation is radiated along the radiation axis 46 by the radiator 42 (the radiation beam is exemplified by radiation rays 60). In an exemplary polarization, the radiator is configured to generate a selected polarization that is aligned along the transverse axis 52. The transreflector is configured to reflect the selected polarization and, accordingly, the radiation beam 60 is reflected along the transverse axis 52 by the transreflector 54.

The radiation beam 60 is next reflected along the transverse axis with a first polarization shift (e.g., 90°) from the first twist reflector 48. The radiation beam is thus transmitted through the transreflector 54 and along the transverse axis 52. Subsequently, the radiation beam 60 is reflected along the transverse axis with a second polarization shift (e.g., 90°) from the second twist reflector 50.

Because the polarization of the radiation beam 60 is now the same as when it issued from the radiator 42, it is now reflected along the transverse axis 46 from the transreflector. Finally, the radiation beam 60 is collimated by the lens 44. That is, the lens 44 converts diverging radiation rays into parallel radiation rays or, equivalently, converts the spherical wavefront (i.e., a surface of in-phase radiation) generated by the radiator 42 into a planar wavefront.

The transverse dimensions of the lens 44 define the antenna's aperture and the aperture is dimensioned to realize the azimuth and elevation beam widths (33 and 34 in FIGS. 1A and 1B). The lens dimension along the transverse axis 52 is associated with the elevation beam width 34 and the dimension along a third antenna transverse axis 62 (an axis orthogonal to both of the radiation and transverse axes 46 and 52) is associated with the azimuth beam width 33. Because beam width is inversely proportional to aperture dimension, the lens 44 has a dimension along the axis 62 that is greater than its dimension along the transverse axis 52.

Figure 4:
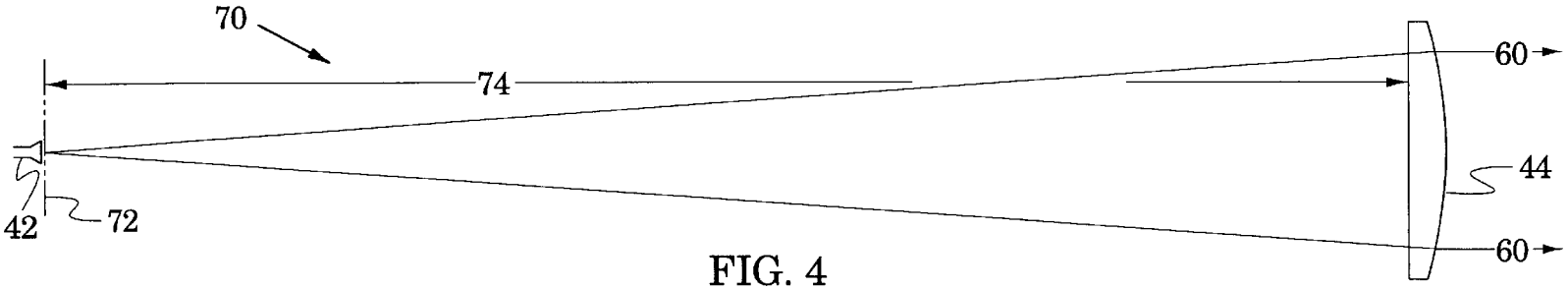
FIG. 4 is a side elevation view of a radiation path of the antenna of FIG. 2 prior to transverse folding which converts it into the folded-path configuration shown in FIG. 3.

The radiator 42 is configured to illuminate the aperture of the lens 44. This is illustrated along a single transverse axis in the focusing diagram 70 of FIG. 4 which includes the antenna's radiating and focusing elements (i.e., the radiator 42 and the lens 44) that are spaced along the radiation axis (46 in FIG. 3). When the antenna is receiving collimated radiation, the lens focuses it at a focal plane 72 that is spaced from the lens by a focal length 74. A radiator 42 (shown in the form of a feed horn) is positioned at the focal plane 74.

Increasing the focal length 74 reduces the antenna's sidelobes which is an important performance parameter (e.g., it affects the antenna's ability to distinguish between objects on its main beam and adjacent objects). In addition, a longer focal length facilitates a thinner lens and therefore a system with less loss. On the other hand, a shorter focal length reduces the antenna's size which is another important parameter (especially in an automotive system).

In order to enhance sidelobe and loss performance while also realizing a compact antenna, the focal path is folded as shown in FIG. 3. In the folded path, the radiation beam 60 traverses the antenna once along the radiation axis 46 and twice along the transverse axis 52. For automotive applications, it is desirable to reduce the antenna's dimensions along both the radiation and the transverse axes 46 and 52. Thus, the antenna's dimensions along these two axes are preferably identical. Because the focal path traverses across the antenna's interior three times, the dimension between the radiator 42 and the lens 44 has been reduced ⅓ from the focal length 74 of FIG. 4.

Figure 5C:
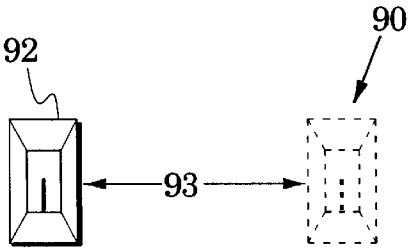
FIG. 5C is a side elevation view of another radiator embodiment for the antenna of FIGS. 2 and 3.
Figure 5B:
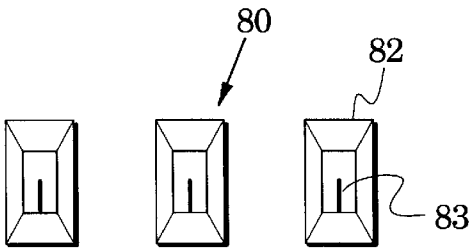
FIG. 5B is a side elevation view of another radiator embodiment for the antenna of FIGS. 2 and 3.
Figure 5A:
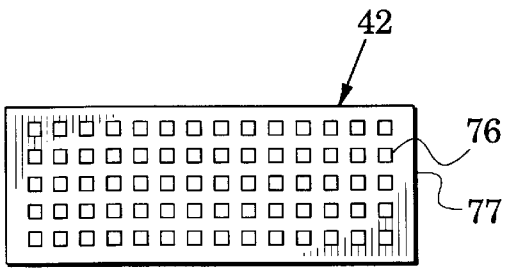
FIG. 5A is a side elevation view of one embodiment of a radiator in the antenna of FIGS. 2 and 3.

FIG. 5A shows that patches 76 of the patch array 42 of FIGS. 2 and 3 are arranged in rows and columns on a low-cost planar substrate 77. Radiation from each column generates a different radiation phase front at the interior face of the lens 44. Accordingly, the collimation process of the lens will direct the radiation rays 60 in a different azimuth direction. That is, successively energizing different patch columns scans the radiation beam 32 of FIG. 1A across the scan angle 36.

The illumination dimension at the lens aperture is inversely proportional to the respective dimension of the radiator. The height of the patch columns is, therefore, increased sufficiently to only illuminate the lens 44 along its transverse axis 52. Along the antenna's other transverse axis 62, an energized portion of the patch array must be narrower in order to illuminate the lens width along this axis. This can be realized at any one instant in time by energizing a sufficient number of adjacent columns.

The radiator of the antenna 40 of FIGS. 2 and 3 can be realized in various other conventional forms. For example, FIG. 5B shows a radiator 80 that is formed from a plurality of feed horns 82. Successively energizing the feed horns 82 scans the beam 32 in FIG. 1A because each feed horn presents a different azimuth wavefront to the lens 44 of FIGS. 2 and 3.

Another radiator 90 is shown in FIG. 5C. In this radiator, a single feed horn 92 is arranged to move transversely (indicated by movement arrow 93) across the back wall 58 of FIGS. 2 and 3 to thus generate different wavefronts at the lens 44.

Figure 6B:
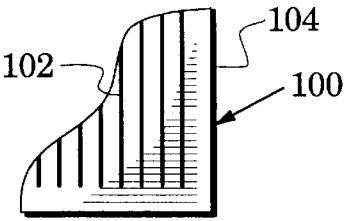
FIGS. 6A and 6B are side elevation views of different embodiments of a twist reflector in the antenna of FIGS. 2 and 3.
Figure 6A:
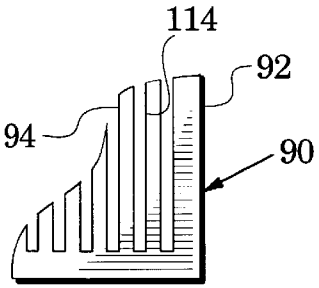

Different embodiments of the transreflector 54 of FIGS. 2 and 3 are shown in FIGS. 6A and 6B. The transreflector 90 of FIG. 6A is formed from a single sheet of conductive metal (e.g., copper). A frame 92 supports a plurality of spaced conductors 94. The transreflector 100 of FIG. 6B is formed from metallic conductors 102 that are deposited onto a dielectric substrate 104.

Figure 7B:
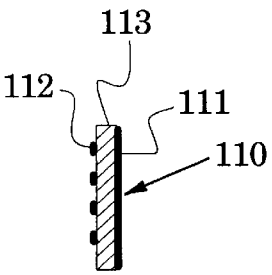
FIG. 7B is a view along the plane 7B—7B of FIG. 7A.
Figure 7A:
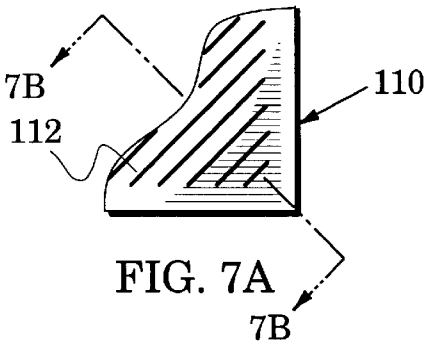
FIG. 7A is a side elevation view of a transreflector embodiment in the antenna of FIGS. 2 and 3.

An exemplary embodiment 110 of the first and second twist reflectors 48 and 50 of FIGS. 2 and 3 is illustrated in FIGS. 7A and 7B. The twist reflector 110 has a ground plane 111 and a plurality of spaced conductors 112 deposited on opposite sides of a dielectric substrate 113. The substrate has a thickness of $\sim\lambda/4$ wherein $\lambda$ is the radiation wavelength of the radiation rays 60 of FIG. 3 and the conductors 112 are arranged to form a 45° angle with the polarization of the radiator (42 in FIGS. 2 and 3). Another twist reflector embodiment is formed by the element 90 of FIG. 6A if the spaces 114 in a sheet of conductive metal represent, instead, slots in a conductive member with a slot depth of $\sim\lambda/4$.

Radiation that strikes the twist reflector at a 45° angle can be visualized as having two orthogonal vector components which are respectively parallel and orthogonal to the conductors 112. The parallel component is reflected with a 180° phase shift. The orthogonal component is reflected from the ground plane 111 with a 180° phase shift and experiences another 180° phase shift as it twice traverses the thickness of the substrate 113. At the surface of the conductors 112, the parallel vector component has been reversed and the orthogonal vector component has not. Accordingly, the polarization of the reflected radiation is spatially shifted by 90°.

Figure 8:
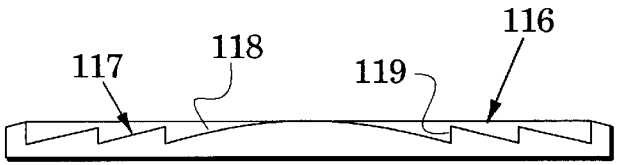
FIG. 8 is a cross sectional view of another lens embodiment in the antenna of FIGS. 2 and 3.

The lens 44 of FIGS. 2 and 3 is shown to have a planar interior surface 114 and an exterior surface 115 that is curved (e.g., in accordance with conventional lens formulas) along both transverse axes 52 and 62. Various other conventional lens configurations can be used. For example, FIG. 8 shows a cross section through a zoned lens 116 in which a curved surface 117 is curved in concentric portions 118 that are caused to be roughly coplanar by steps 119. Although somewhat more difficult to manufacture, the zoned lens 116 is thinner which reduces its size and its loss (the loss reduction is partially negated by radiation shadowing at the steps 119).

Figure 9:
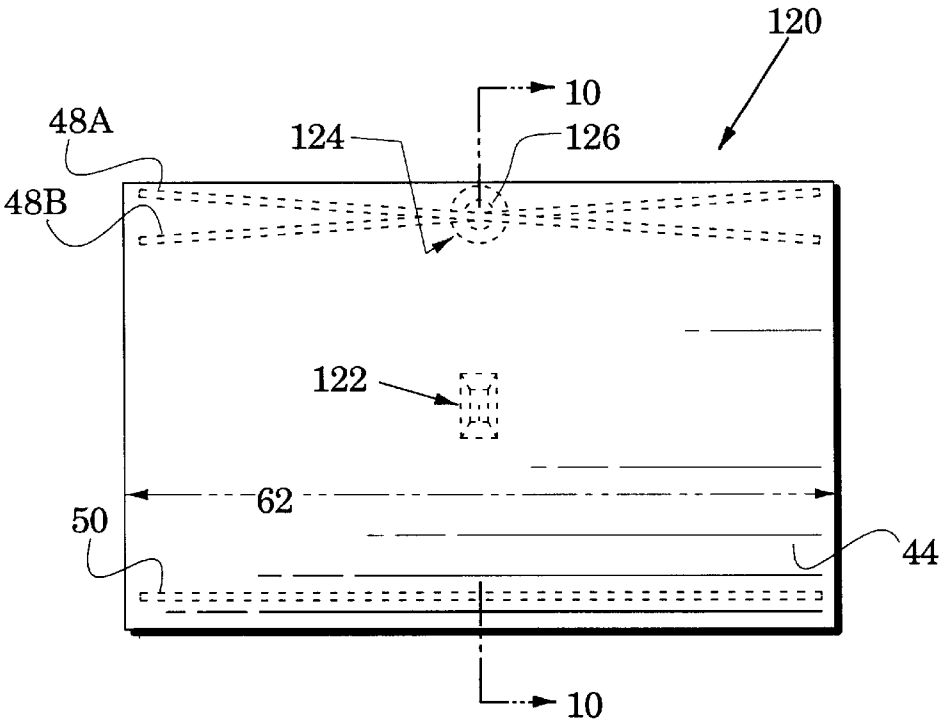
FIG. 9 is a front elevation view of another embodiment of the antenna of FIGS. 1A and 1B.
Figure 10:
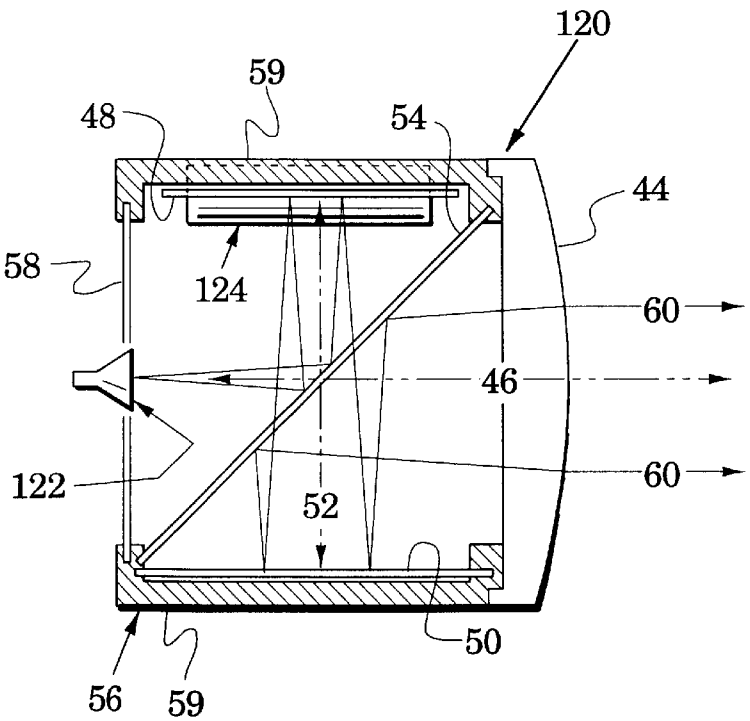
FIG. 10 is a view along the plane 10—10 of FIG. 9.

Another embodiment 120 of the antenna 30 of FIGS. 1A and 1B is shown in FIGS. 9 and 10. The antenna 120 is similar to the antenna 40 of FIGS. 2 and 3 with like elements indicated by like reference numbers. In contrast to the antenna 40, however, the antenna's radiator is a single feed horn 122.

In addition, the first twist reflector 48 is pivotably mounted in the frame 56 and controlled by an actuator, e.g., a partial-angle rotational actuator 124. Preferably, the actuator is a low-cost coil-type actuator that is configured for repetitive alternating rotational movement. Such actuators generate almost no audible noise (an important consideration in consumer products) and are commercially available. The actuator repetitively pivots the first twist reflector 48 about a pivot 126 and between extreme positions 48A and 48B as seen in FIG. 9 (this movement can be accommodated, for example, by suitable shaping of the respective side wall 59).

In operation of the antenna 120, accordingly, the radiation wavefront strikes the lens 44 at different angles along the antenna axis 62 of FIG. 2. This causes the beam 32 of FIG. 1A to scan along different angles (i.e., to scan across the scan angle 36). A pivot, for example, of 7.5 degrees generates a scan angle of 5 degrees. The pivoting is preferably effected with a repetition rate (e.g., 5 Hz) that is sufficient to safely update the positions of objects in front of the motor vehicle 24.

Another embodiment can be formed by pivoting the second twist reflector 50 rather than the first twist reflector 48. This embodiment provides a greater scan angle (e.g., a pivot of 7.5 degrees generates a scan angle of 10 degrees). In addition, the illumination of this embodiment has less movement across the lens 44.

Figure 11:
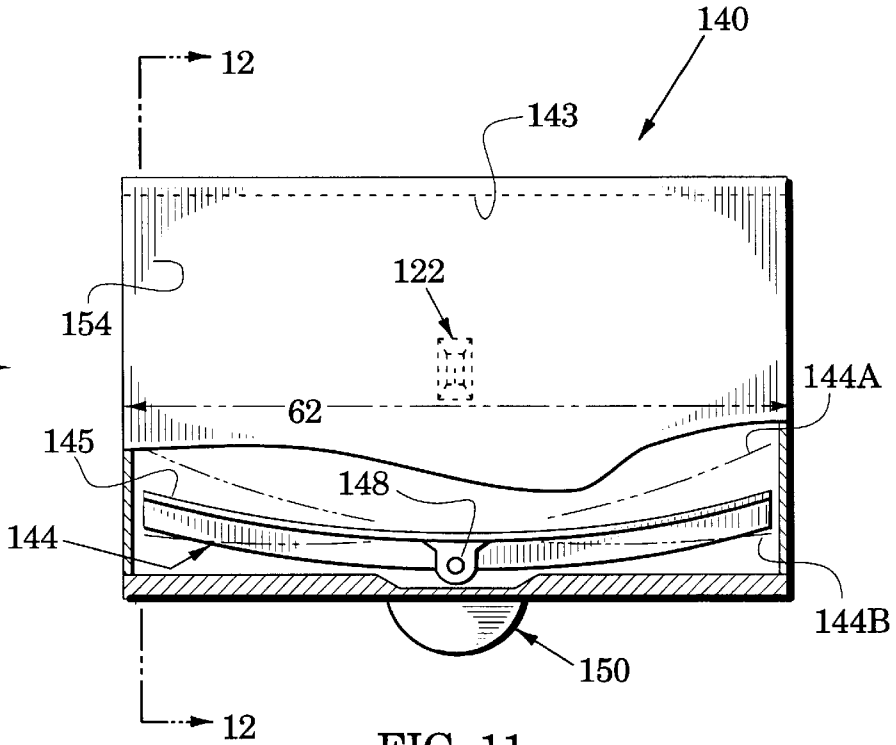
FIG. 11 is a front elevation view of another embodiment of the antenna of FIGS. 1A and 1B.
Figure 12:
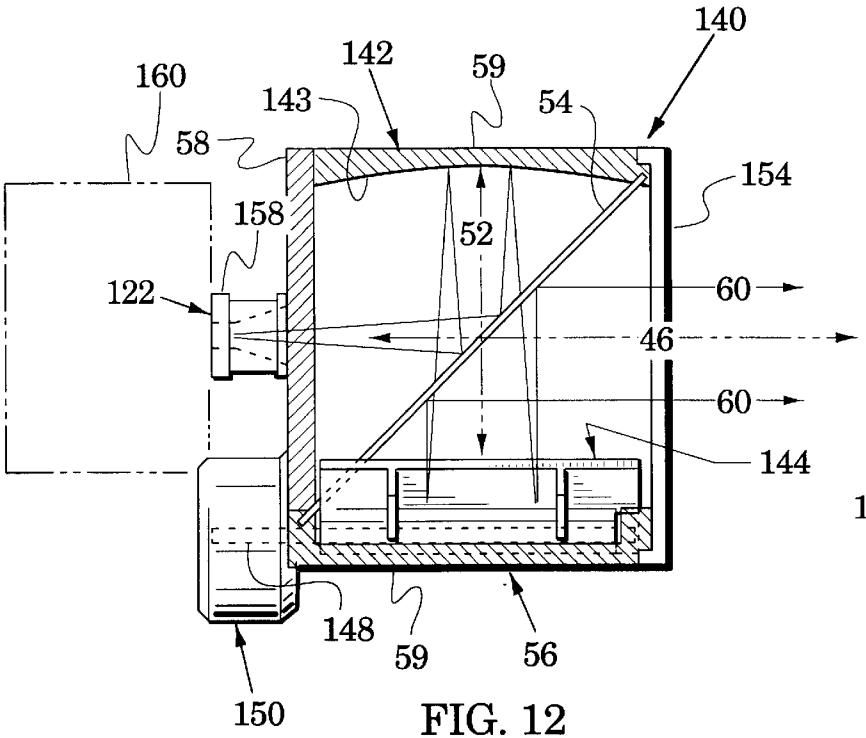
FIG. 12 is a view along the plane 12—12 of FIG. 11.

Another embodiment 140 of the antenna 30 of FIGS. 1A and 1B is shown in FIGS. 11 and 12. The antenna 140 is also similar to the antenna 40 of FIGS. 2 and 3 with like elements indicated by like reference numbers. In contrast to the antenna 120, however, the antenna has first and second twist reflectors 142 and 144 that have respective curved reflecting surfaces 143 and 145 (e.g., parabolic or cylindrical curves). The surface 143 is curved along the radiation axis 46 and the surface 145 is curved along the transverse axis 62 (also shown in FIG. 11).

In addition to being curved, the second twist reflector is pivotably carried in the frame 56 by a pivot 148 and controlled by a partial-angle rotational actuator 150. The actuator repetitively pivots the second twist reflector 144 about the pivot 148 and between extreme positions 144A and 144B as seen in FIG. 11. A pivot, for example, of 7.5 degrees generates a scan angle of 15 degrees in this embodiment.

In operation of the antenna 140, the curved surface 143 of the first twist reflector 142 collimates the radiation rays 60 along the radiation axis 46. Because of the folding process of the antenna, this collimates the beam 32 of FIG. 1B along the vertical beam width 34. In contrast, the curved surface 145 of the second twist reflector 144 collimates the radiation rays 60 along the transverse axis 62 (shown in FIGS. 2 and 11). Because of the folding process of the antenna, this collimates the beam 32 of FIG. 1B along the azimuth beam width 33.

Because the first and second twist reflectors 142 and 144 cooperatively collimate the radiation rays 60, the lens 44 has been replaced in the antenna 140 with a protective low-loss radome 154. In FIG. 11, the radome 154 has been cut away to clarify details of the second twist reflector 144. The repetitive partial-angle motion that is effected by the actuator 150 causes the wavefront of the collimated radiation to exit the radome 154 at different angles along the antenna axis 62. This causes the beam 32 of FIG. 1A to scan along different angles (i.e., to scan across the scan angle 36).

In addition to the antenna 140 of FIGS. 11 and 12, the automotive radar 22 of FIGS. 1A and 1B includes a signal generating, receiving and processing unit 26. Various conventional realizations of this unit may include a waveguide which couples the unit to a flange 158 of the feed horn 122. The signal generating, receiving and processing unit 26 is exemplified in FIG. 12 by broken lines 160. Because of illustration restraints, this envelope is shown smaller than an actual realization of the unit.

As previously stated, space is limited in automotive radar applications. Because of automotive spatial considerations, space is especially limited along the transverse axis 52. Thus, the antennas of the invention are particularly advantageous because they position their radiators adjacent to the back wall 58 which facilitates positioning the signal generating, receiving and processing unit 26 in a location where space is less limited.

In contrast to conventional antennas, embodiments of the invention not only teach lenses for radiation collimation but also teach twist reflectors which are curved along different transverse axes (e.g., transverse axes 52 and 62 in FIGS. 11 and 12). The invention further teaches pivoting of one of these twist reflectors as a simple, inexpensive, durable way to realize beam scanning. Still other embodiments of the invention realize beam scanning through radiator translation (e.g., with patch elements of a radiator array).

Antennas of the invention are preferably configured to operate with short wave lengths (e.g., millimeter wave lengths) to further enhance their compactness. Preliminary tests of embodiments of the invention indicate they can achieve low loss (e.g., on the order of 1.2 dB at 76.5 GHz) and wide (e.g., on the order of 20°) scan angles (36 in FIG. 1A). Lens-based embodiments are not only compact but achieve low side lobes (e.g., on the order of 20 dB) and reflector-based embodiments have even better side lobe performance (e.g., on the order of 30 dB).

Embodiments of the invention have been described with radiators that generate an exemplary vertical polarization. Other embodiments can use other polarizations (e.g., horizontal). In the twist reflectors of the invention, the spacing between conductors (e.g., 112 in FIGS. 7A and 7B) is preferably limited to reduce the generation of grating lobes. The radiators are preferably configured to illuminate antenna apertures with an amplitude taper to reduce sidelobe power.

Although antenna embodiments have been illustrated with elements (e.g., radiators and pivotable reflectors) that facilitate scanning of their radiation beams, other useful embodiments of the invention can be formed with stationary versions of these elements to form stationary beams. Although other embodiments are useful, antennas of the invention preferably orthogonally arrange their radiation and transverse axes (46 and 52 in FIG. 3) and tilt their transreflector (54 in FIG. 3) from each of these axes by substantially 45°.

As is well known, antennas have the property of reciprocity, i.e., the characteristics of a given antenna are the same whether it is transmitting or receiving. The use of terms such as radiator axis, radiation and collimation in the description and claims are for convenience and clarity of illustration and are not intended to limit the teachings of the invention. An antenna which can generate and collimate an electromagnetic beam can inherently receive and focus a reflected beam.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A transverse-folded antenna, comprising:

a radiator positioned to radiate electromagnetic radiation along an antenna radiation axis;

first and second twist reflectors spaced apart along an antenna transverse axis that is transverse to said radiation axis; and a transreflector positioned across said radiation axis and said transverse axis;

electromagnetic radiation from said radiator thereby successively reflected along said transverse axis from said transreflector, reflected along said transverse axis with a first polarization twist from said first twist reflector, transmitted along said transverse axis and through said transreflector, reflected along said transverse axis with a second polarization twist from said second twist reflector and reflected along said radiation axis from said transreflector.

2. The transverse-folded antenna of claim 1, wherein at least one of said first and second twist reflectors is curved to facilitate collimation of said radiation.

3. The transverse-folded antenna of claim 2, wherein at least one of said first and second twist reflectors is rotatably mounted to facilitate scanning of said radiation.

4. The transverse-folded antenna of claim 1, further including an electromagnetic lens positioned across said radiation axis with said transreflector between said radiator and said lens, said lens facilitating collimation of said radiation.

5. A transverse-folded antenna, comprising:

a radiator positioned to radiate electromagnetic radiation along an antenna radiation axis;

an electromagnetic lens spaced from said radiator along said radiation axis;

first and second twist reflectors spaced apart along an antenna transverse axis that is transverse to said radiation axis; and a transreflector positioned between said radiator and said lens and between said first and second twist reflectors;

electromagnetic radiation from said radiator thereby successively reflected along said transverse axis from said transreflector, reflected along said transverse axis with a first polarization twist from said first twist reflector, transmitted along said transverse axis and through said transreflector, reflected along said transverse axis with a second polarization twist from said second twist reflector, reflected along said radiation axis from said transreflector and collimated by said lens.

6. The transverse-folded antenna of claim 5, wherein said transverse axis is orthogonal to said radiation axis.

7. The transverse-folded antenna of claim 6, wherein said transreflector is tilted from each of said radiation and transverse axes by substantially 45 degrees.

8. The transverse-folded antenna of claim 5, wherein at least a selected one of said first and second twist reflectors is pivotably mounted to facilitate scanning of said radiation.

9. The transverse-folded antenna of claim 8, further including a frame which pivotably carries said selected twist reflector.

10. The transverse-folded antenna of claim 8, further including a partial-angle actuator coupled to repetitively pivot said selected twist reflector.

11. The transverse-folded antenna of claim 5, wherein said first and second twist reflectors each include:

a plurality of spaced conductors; and a ground plane spaced from said conductors.

12. The transverse-folded antenna of claim 5, wherein said first and second twist reflectors each include a metallic member that defines a plurality of slots which each have a slot depth of $\sim\lambda/4$.

13. The transverse-folded antenna of claim 5, wherein said radiator is a feed horn.

14. The transverse-folded antenna of claim 5, wherein said radiator is a patch antenna to facilitate scanning of said radiation.

15. The transverse-folded antenna of claim 5, wherein said radiator is a plurality of spaced feed horns to facilitate scanning of said radiation.

16. The transverse-folded antenna of claim 1, wherein said transreflector includes a plurality of spaced conductors.

17. A transverse-folded antenna, comprising:

a radiator positioned to radiate electromagnetic radiation along an antenna radiation axis;

first and second twist reflectors spaced apart along an antenna transverse axis that is transverse to said radiation axis; and a transreflector positioned across said radiation axis and said transverse axis;

wherein, to facilitate collimation of said radiation, one of said first and second twist reflectors is curved along said radiation axis and the other is curved along a third antenna axis that is transverse to said radiation and transverse axes;

electromagnetic radiation from said radiator thereby successively reflected along said transverse axis from said transreflector, reflected along said transverse axis with a first polarization twist from said first twist reflector, transmitted along said transverse axis and through said transreflector, reflected along said transverse axis with a second polarization twist from said second twist reflector and reflected along said radiation axis from said transreflector.

18. The transverse-folded antenna of claim 17, wherein said transverse axis is orthogonal to said radiation axis.

19. The transverse-folded antenna of claim 18, wherein said transreflector is tilted from each of said radiation and transverse axes by substantially 45 degrees.

20. The transverse-folded antenna of claim 18, wherein at least a selected one of said first and second twist reflectors is pivotably mounted to facilitate scanning of said radiation.

21. The transverse-folded antenna of claim 20, further including a frame which pivotably carries said selected twist reflector.

22. The transverse-folded antenna of claim 21, further including a partial-angle actuator coupled to repetitively pivot said selected twist reflector.

23. The transverse-folded antenna of claim 17, wherein said first and second twist reflectors each include:

a plurality of spaced conductors; and a ground plane spaced from said conductors.

24. The transverse-folded antenna of claim 17, wherein said first and second twist reflectors each include a metallic member that defines a plurality of slots which each have a slot depth of $\sim\lambda/4$.

25. The transverse-folded antenna of claim 17, wherein said radiator is a feed horn.

26. The transverse-folded antenna of claim 17, wherein said radiator is a patch antenna to facilitate scanning of said radiation.

27. The transverse-folded antenna of claim 17, wherein said transreflector includes a plurality of spaced conductors.

28. A motor vehicle system, comprising:

a motor vehicle; and a radar system carried by said motor vehicle wherein said radar system includes:

a signal generating, receiving and processing unit; and a transverse-folded antenna directed ahead of said motor vehicle, said antenna including:

a) a radiator coupled to said unit and positioned to radiate electromagnetic radiation along an antenna radiation axis;

b) first and second twist reflectors spaced apart along an antenna transverse axis that is transverse to said radiation axis; and c) a transreflector positioned across said radiation axis and said transverse axis;

electromagnetic radiation from said radiator thereby successively reflected along said transverse axis from said transreflector, reflected along said transverse axis with a first polarization twist from said first twist reflector, transmitted along said transverse axis and through said transreflector, reflected along said transverse axis with a second polarization twist from said second twist reflector and reflected along said radiation axis from said transreflector.

29. The motor vehicle system of claim 28, wherein at least one of said first and second twist reflectors is curved to facilitate collimation of said radiation.

30. The motor vehicle system of claim 28, wherein at least one of said first and second twist reflectors is rotatably mounted to facilitate scanning of said radiation.

31. The motor vehicle system of claim 28, further including an electromagnetic lens positioned across said radiation axis with said transreflector between said radiator and said lens, said lens facilitating collimation of said radiation.

* * * * *